US006042069A

United States Patent [19]

Christianson

[11] Patent Number: 6,042,069

[45] Date of Patent: Mar. 28, 2000

[54] EXPANDING CLIMBING AID

[76] Inventor: Tony Christianson, 2007 Wawona Station, Yosemite, Calif. 95389

[21] Appl. No.: 09/128,499

[22] Filed: Aug. 3, 1998

[51] Int. Cl.[7] ..... A47F 5/08

[52] U.S. Cl. ..... 248/231.9; 248/925

[58] Field of Search ..... 248/231.9, 925, 248/694; 482/37

[56] References Cited

U.S. PATENT DOCUMENTS

| | | | |
|---|---|---|---|
| 4,184,657 | 1/1980 | Jardine | 248/231.9 |
| 4,565,342 | 1/1986 | Grow | 248/231.9 |
| 4,575,032 | 3/1986 | Taylor | 248/231.9 |
| 4,643,377 | 2/1987 | Christianson | 248/231.9 |
| 4,645,149 | 2/1987 | Lowe | 248/231.9 |
| 4,781,346 | 11/1988 | Banner | 248/231.9 |
| 4,832,289 | 5/1989 | Waggoner | 248/231.9 |
| 5,860,629 | 1/1999 | Reed | 248/231.9 |

*Primary Examiner*—Ramon O. Ramirez
*Assistant Examiner*—Stephen S. Wentsler

[57] ABSTRACT

The present invention is an improved mechanically expanding climbing aid which includes one or more pair of opposed cam members pivoting with crossed radii on eccentric bearings. The eccentric bearings are mounted on a single high strength shaft. The invention is specifically configured to be placed in cracks having side that are spaced under 1 cm.

15 Claims, 4 Drawing Sheets

EXPANDING CLIMBING AID

BACKGROUND OF THE INVENTION

1. Field of the Invention

The present invention is generally related to climbing aids. More particularly, this invention is related to mechanically expanding climbing aids which engage cracks in rock and function as a secure anchor to protect climbers by either preventing or arresting a fall.

2. Description of the Prior Art

Climbers utilize rope, slings, harnesses and a variety of mechanical devices as climbing aids to assist and protect their movement over rock. The climbing aids serve as a means to securely anchor the rope, and thereby the climber, to the rock face for the purpose of either preventing or arresting a fall.

During a climb and especially in the event of a fall, the climber's safety is dependent on the security of numerous anchors. Consequently, it is imperative that an anchor be able to withstand not only the weight of the climber but also the inertial forces generated when the rope arrests a fall.

A secure anchor can sometimes be accomplished by wedging a solid object of fixed shape into a crack in the rock. Such solid, fixed shape climbing aids are known in the climbing community as chocks or nuts. Chocks and nuts are available in a variety of shapes and sizes in order to accommodate variations in the shape and width of the cracks which a climber may encounter.

U.S. Patents have issued which describe solid, fixed shape chocks and nuts. For example, U.S. Pat. No. 3,948,485 entitled "Irregular Polygonal Mountaineering Chock" issued to Yvon Chouinard and Thomas Frost on Apr. 6, 1976 teaches a polygonal shaped chock. U.S. Pat. No. 4,082,241 entitled "Chock for Mountain Climbing" issued to John Brent on Apr. 4, 1975 teaches a chock for mountain climbing which is in the form of a truncated pyramid. U.S. Pat. No. 4,422,607 entitled "Climbing Chocks" issued to Mark Vallance on Dec. 27, 1983 teaches a chock having a generally wedged shaped body with two opposite side faces of which are respectively of concave and convex configuration.

Climbing aids of solid, fixed shape are not very effective in wide, smooth, parallel sided, or openly flaring cracks. For such applications, mechanically expanding climbing aide have been developed. For example, U.S. Pat. No. 3,877,679 entitled "Anchor Device for Mountain Climbers" issued to Greg Lowe on Apr. 15, 1975 teaches a climbing aid which includes a body having an arcuate cam surface which is configured to spiral outward to the rock as it rotates about a pivot. U.S. Pat. No. 4,184,657 entitled "Climbing Aids" issued to Raymond Jardine on Jan. 22, 1980 teaches a climbing aid which includes two pairs of cam members which are pivotally mounted on a single spindle and are shaped such that movement progressively spirals the cam surfaces outward thereby jamming the climbing aid within the crack. U.S. Pat. No. 4,565,342 entitled "Anchoring Device for Rock Climbing" issued to Robert Grow on Jan. 21, 1986 and U.S. Pat. No. 4,575,032 entitled "Rock Climbing Adjustable Chock" issued to Peter Taylor on Mar. 11, 1986 both teach single axle, multi-cam devices similar to the climbing aid of Jardine.

All of the mechanically expanding climbing aids described supra have shortcomings which limit their usefulness. High jamming forces, which are generated when a load is applied, are directed to and concentrated at the ends of a single, relatively long shaft which can lead to structural failure due to bending. Spaced, staggered mounting of opposing cam members on the common shaft produce high bending couples, which can also lead to structural failure. Pivoting cam member on a common shaft necessitates a relatively tight cam surface curvature which concentrates frictional forces over a small contact area, resulting in rapid cam wear. Some loading situations force the climbing aid sideways which act to bend and break the rigid components, thereby leading to potentially catastrophic failure. Also, although the climbing aid expanding members typically swing through a 90° arc from fully retracted to the fully expanded position, only the central 45° arc of movement is practical for use, thereby requiring that a relatively large number of mechanically expanding climbing aid sizes be carried in order to accommodate the full range of crack widths which a climber may encounter.

In view of the shortcomings characteristic of the prior art, an improved mechanically expanding climbing aid was taught by the applicant's Application Number 780,375 filed Sep. 26, 1985 now U.S. Pat. No. 4,643,377 which issued Feb. 17, 1987. The applicant's improved mechanically expanding climbing aid features two parallel axles on which opposing cam members rotate separately with crossed radii. As a result of the double axle structure, the cam members closely intermingle when retracted thereby significantly increasing the useful range of cam member movement from fully retracted to fully expanded. Consequently, a lower number of sizes are needed by the climber to accommodate the range of crack widths encountered while climbing. Because the cam member rotational radii are crossed and subsequently longer than radii of an equivalently sized single axle climbing aid, leverage and the resulting anchoring force are significantly greater. Similarly, because the cam member arcuate outer surface curvature is broader than that of an equivalently sized single axle climbing aid, the contact area with the crack walls is increased thereby reducing cam surface wear. Also, because bearing loads are shared equally by two axles instead of a single axle, the improved mechanically expanding climbing aid avoids structural failure due to high bending forces and couples.

The climbing aid taught by U.S. Pat. No. 4,643,377 is marketed under the trade name "Camalot". Camalot is manufactured in a range of overlapping sizes to accommodate crack widths from 2 to 18 cm (¾ to 7 inches). The various overlapping sizes are essentially the same configuration with the component dimensions scaled up or down to achieve the desired expansion range. Scaling the Camalot double axle configuration small enough to accommodate crack widths under 2 cm has not been practical due to physical constraints. For example, 4 mm is the smallest useful diameter for an axle of adequate strength using state of the art materials, and it is not possible to have parallel 4 mm diameter axles spaced to mount interlocking cams and also have an assembly thin enough to provide the clearance needed to slip into cracks less than 2 cm wide. Even so, there is significant need in the climbing community for mechanically expanding climbing aids which can be placed in cracks under 1 cm wide and also have the wide expansion range and strength provided by cam members pivoting with crossed radii.

SUMMARY OF THE INVENTION

It is the objective of the present invention to provide a mechanically expanding climbing aid having opposing cam members which pivot separately with crossed radii, but additionally has the ability to be placed in cracks having sides that are spaced under 1 cm. The two axis of rotation for the crossed radii are provided by eccentric bearings mounted on a single high strength rod. Mounting eccentric bearings on a single rod provides a compact crossed radii assembly which can be fabricated thin enough to fit in cracks under 1 cm wide.

DESCRIPTION OF THE DRAWINGS

A detailed description of the invention is made with reference to the accompanying drawings wherein like numerals designate corresponding parts in the several FIGS.

DESCRIPTION OF THE PREFERRED EMBODIMENT

The following detailed description is of the best presently contemplated modes of carrying out the invention. This description is not to be taken in a limiting sense, but is made merely for purposes of illustrating the general principles of the invention.

Figure 1:
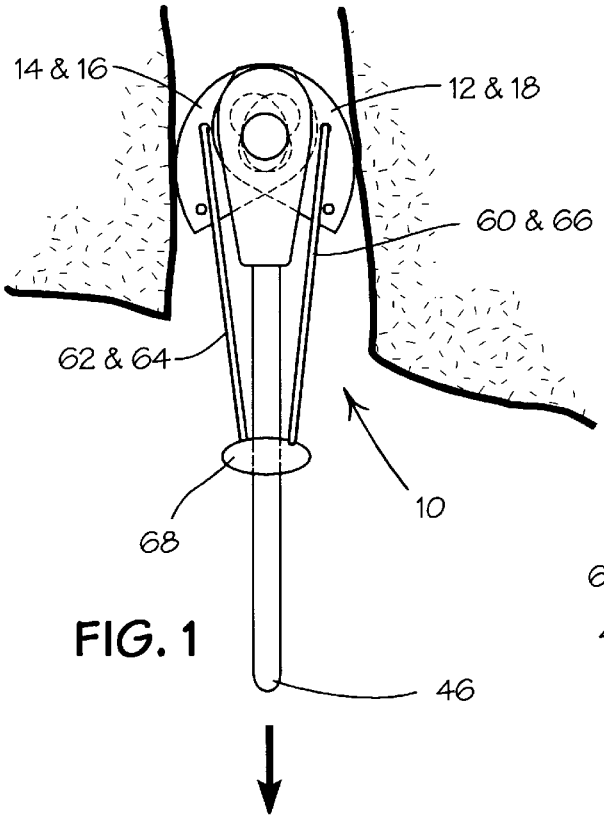
FIG. 1 is a pictorial view of an improved climbing aid which has been constructed in accordance with the teachings of the present invention and which is inserted in rock crack, or the like, and firmly anchored by an outwardly directed load.

Referring to FIG. 1, an outwardly directed load has firmly anchored improved climbing aid 10 within the generally parallel walls of a crack in rock, or the like. The cam members are shown partially expanded as a result of the spacing of the crack walls. The outwardly directed load is depicted by a bold arrow.

Figure 2:
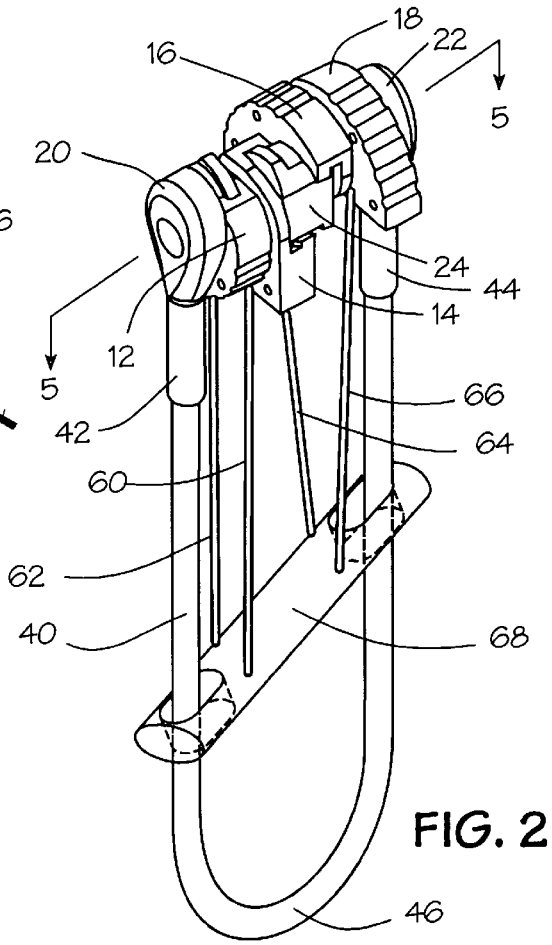
FIG. 2 is an isometric view of the climbing aid of FIG. 1.
Figure 5:
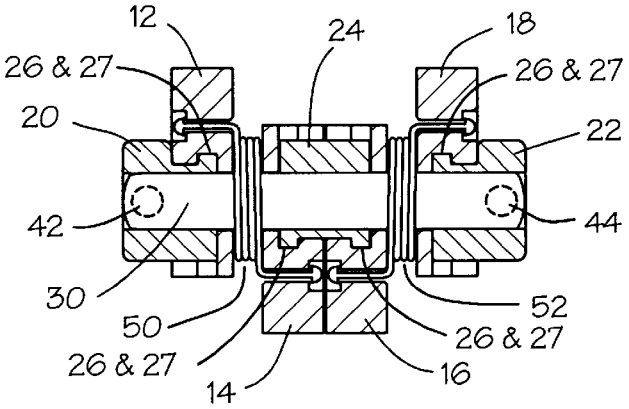
FIG. 5 is a top section of the climbing aid of FIG. 1 viewed in the direction 5—5 in FIG. 2.
Figure 8:
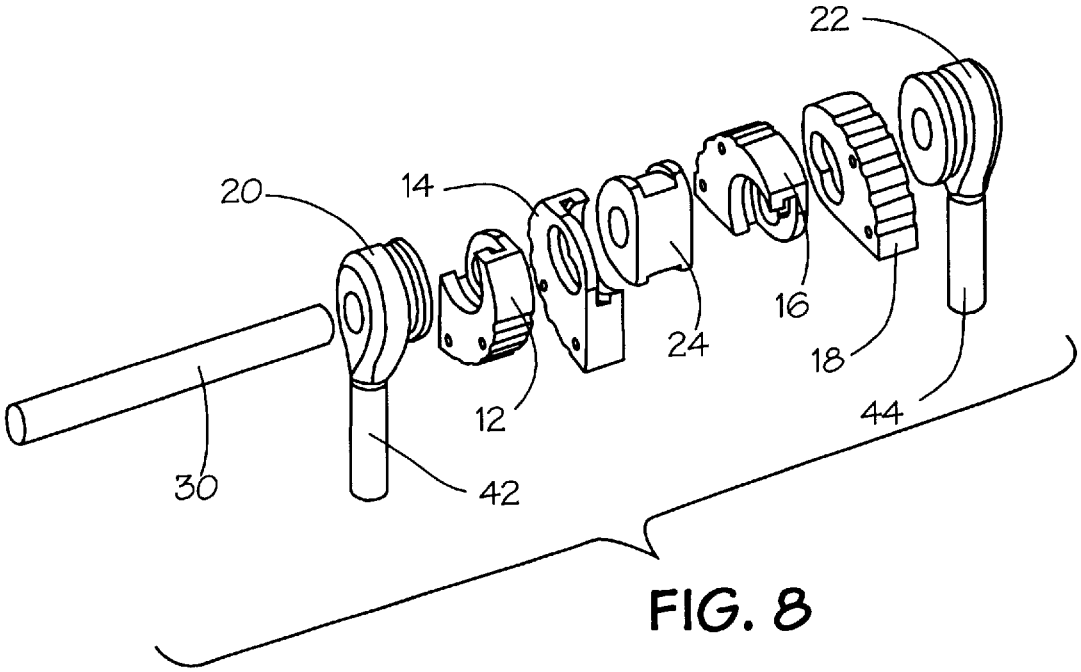
FIG. 8 is an exploded isometric view of the cam members and respective eccentric bearings.

Referring to FIGS. 2, 5, and 8, improved climbing aid 10 includes a first pair of opposing cam members 12 and 14, and a second pair of opposing cam members 16 and 18. Cam members 12 and 18 pivot or rotate on the cylindrical surface of outer eccentric bearings 20 and 22 respectively. Outer eccentric bearings 20 and 22 are oriented so that the respective cam members share a common off-center axis of rotation. Cam members 14 and 16 pivot or rotate on the cylindrical surface of common inner eccentric bearing 24 and therefore also share a common off-center axis of rotation. Inner eccentric bearing 24 is oriented to place its off-center axis of rotation opposite the off-center axis of rotation of eccentric bearings 20 and 22.

Figure 3:
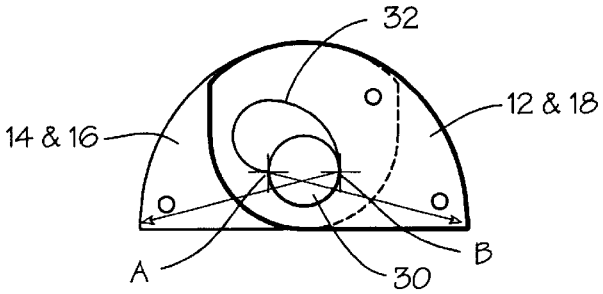
FIG. 3 is a side view showing the profiles of a pair of cam members.
Figure 4:
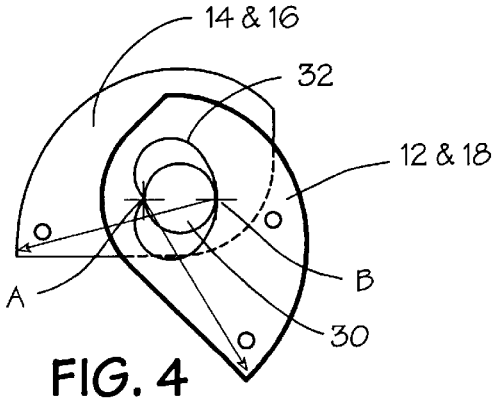
FIG. 4 is a second side view showing the profiles of a pair of cam members.
Figure 7:
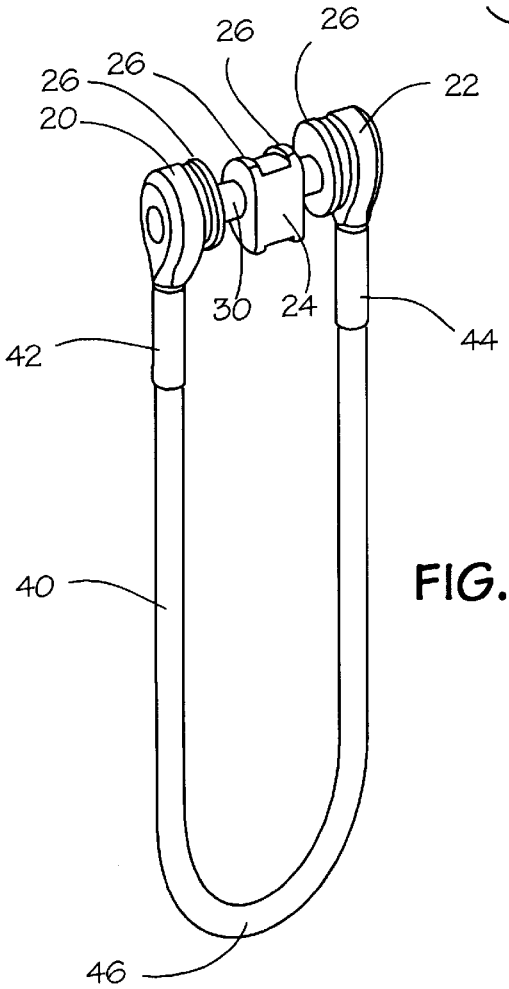
FIG. 7 is an isometric view of the eccentric bearing and rope attachment assembly.

As shown in FIG. 1, the arcuate outer surfaces of cam members 12,14, 16 and 18 are configured to spiral progressively outward as they rotate on the respective eccentric bearings until contact is made with the crack walls. Referring to FIGS. 3 and 4, cam members 12 and 18, and opposing cam members 14 and 16 do not rotate about a single, common axis. Cam members 12 and 18 rotate around off-center axis of rotation "A" whereas cam members 14 and 16 rotate around off-center axis of rotation "B". The separate off-center axes of rotation "A" and "3" are situated such that the opposing cam members pivot with crossed radii (depicted as an elongated arrow radiating from the axis of rotation). FIG. 3 pictures the opposing cam members at their extended positions. FIG. 4 pictures cam members 12 and 18 rotated approximately 45° toward their retracted positions. The movement of the crossed radii is apparent when FIG. 4 is compared to FIG. 3. As best shown in FIG. 7, the separated axis of rotation of improved climbing aid 10 are provided by the relative orientation of eccentric bearings 20, 22 and 24.

As a result of the offset axis of rotation, the cam members closely intermingle when fully retracted thereby significantly increasing the useful range of cam member movement from fully retracted to fully expanded. Consequently, a lower number of improved climbing aid 10 overlapping sizes is needed to accommodate the range of crack widths which a climber encounters.

Also, because the cam member rotational radii of improved climbing aid 10 are crossed and subsequently longer than radii of an equivalently sized single pivot climbing aid, locking leverage and resulting anchoring force are significantly greater. Similarly, because the cam member arcuate outer surface curvature of improved climbing aid 10 is broader than that of an equivalently sized single pivot climbing aid, the contact area with the crack walls is increased thereby reducing cam member outer surface wear.

Figure 6:
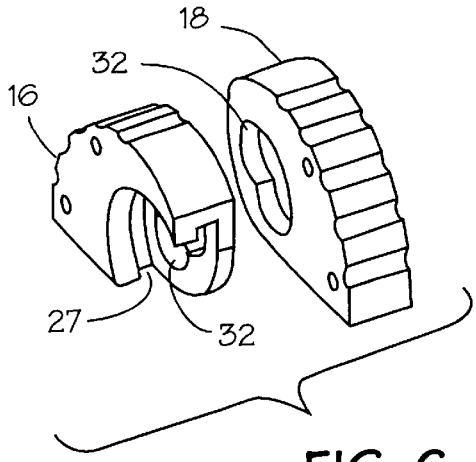
FIG. 6 is an isometric view of a pair of opposing cam members.

Referring to FIGS. 5, 6 and 7, each eccentric bearing incorporates an arcuate ridge 26 which mates with a corresponding arcuate recess 27 on the sliding surface of the respective cam member. Ridge 26 and corresponding recess 27 interlock to keep the cam member centered on the eccentric bearing. Although in the preferred configuration a single ridge 26 and its corresponding interlocking recess 27 are rectangular in cross section, other cross sectional shapes can advantageously provide an interlock between the two components, for example: triangular or dovetailed or circular or curved, of which there can be one or more on the interlocking sliding surface of each cam member.

As shown in FIGS. 7 and 8, eccentric bearings 20, 22 and 24 are connected by single transverse bar 30. Because the relative orientations and spacing of the eccentric bearings must be fixed and maintained, eccentric bearings 20, 22 and 24 are connected, and locked in place by press fit with bar 30. In the preferred configuration, bar 30 is rod of circular cross section. The press fit of eccentric bearings 20, 22 and 24 to bar 30 can be enhanced by knurling the surface of bar 30. Alternately, eccentric bearings 20, 22 and 24 can be slotted, or the like, and keyed to corresponding slots, or the like, on bar 30. As another alternative, the eccentric bearings can be broached, or the like, to receive a bar of rectangular or elliptical or any other cross sectional shape. For additional structural security, the ends of bar 30 can be peened or bolted or the like.

As best shown by FIG. 7, mounting eccentric bearings on a single rod provides a compact crossed radii assembly which can be fabricated thin enough to fit in cracks under 1 cm wide.

As best seen in FIGS. 3, 4 and 6, each cam member includes an open cutout 32. Cutout 32 is shaped and located to enable the cam member to rotate approximately 90° on its respective eccentric bearing but not interfere with transverse connecting bar 30. Cutout 32 is advantageously shaped to limit the range of angular movement of the cam member by providing limit stops against bar 30. Additionally, bar 30 passing through cutout 32 serves to keep the cam member mated and interlocked with its respective eccentric bearing.

Cam members 12, 14, 16 and 18 are fabricated of a suitable lightweight, high strength material, for example aluminum alloy type 6061 or 7075 heat treated to condition T6. Eccentric bearings 20, 22 and 24 are fabricated from a high strength material which provides compatible sliding movement with cam members 12, 14, 16 and 18, for example brass or stainless steel. Bar 30 is fabricated of the highest strength material, for example heat treated nickel-chromium-molybdenum steel alloy type 4340 or equivalent.

Referring to FIG. 2, improved climbing aid 10 includes a rope attachment consisting of looped cable 40 joined at one end 42 to outer eccentric bearing 20 and at the other end 44 to outer eccentric bearing 22. Secure joining of cable ends 42 and 44 to eccentric bearings 20 and 22 respectively can be accomplished by brazing or swaging or the like.

Cable 40 forms a U-shaped member which has legs of equal length. The curved portion 46 of the U-shaped member is the location where the climber attaches a climbing rope. Curved portion 46 can be advantageously covered with a plastic or metal sheath or the like which serves both to maintain the U-shape of cable 40 and to provide a smooth surface for attachment of the climbing rope.

Figure 9:
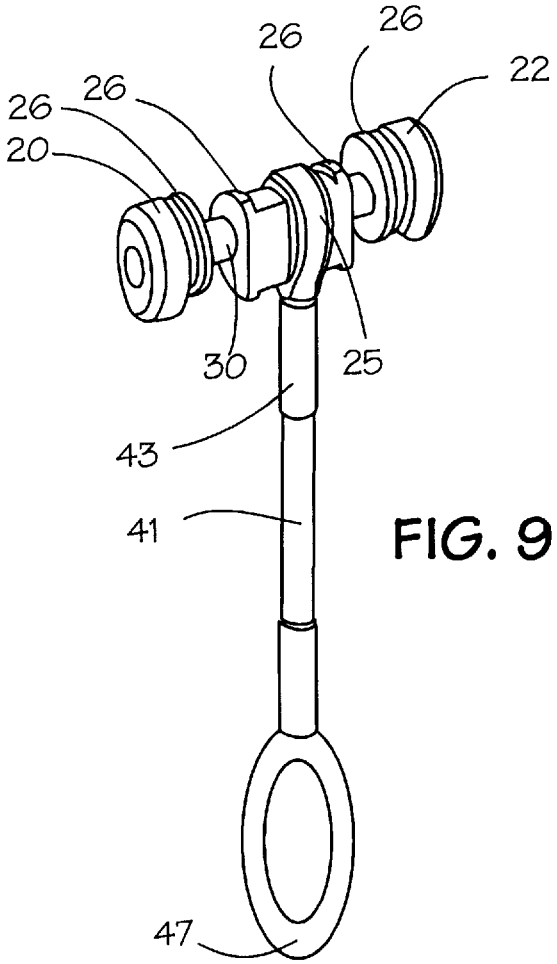
FIG. 9 is an isometric view of an alternate eccentric bearing and rope attachment assembly.

Cable 40 is a high strength wire rope which is capable of sustaining repeated tension, bending and flexural loads without a reduction in strength. Alternately, cable 40 can be replaced by a single rigid bar bent into a U-shape. FIG. 9 shows an alternate rope attachment configuration in which cable 40 is replaced by single centrally located bar or cable 41 joined at one end 43 to inner eccentric bearing 25 and having an opening at the other end 47 for attachment of the climbing rope.

As best seen in FIG. 5, a first coiled torsion spring 50 is loosely wrapped around bar 30 between opposing cam members 12 and 14. The ends of torsion spring 50 are attached, one end to cam member 12, the other end to cam member 14 such that the cams are independently urged in opposite directions toward their fully extended positions. The loose wrapping of the torsion spring allows for eccentric movement of the opposing cams without binding the spring against bar 30. Similarly, a second torsion spring 52 urges opposing cam members 16 and 18 toward their fully extended positions. Independent movement of cam members 12, 14, 16 and 18 by their respective torsion springs 50 and 52 enable all of the cam members to make contact with non-parallel or uneven crack walls.

Referring to FIGS. 1 and 2, one end of operating link 60 is attached near the periphery of cam member 12 so that the operating link will counteract the torsional force of spring 50 when the operating link is moved toward climbing rope attachment 46. Similarly, operating links 62, 64 and 66 are attached to cam members 14,16 and 18 respectively. The other ends of operating links 60, 62, 64 and 66 are attached to operating bar 68. Operating bar 68 is located within finger reach of the climbing rope attachment 46. By manually pulling operating bar 68 toward climbing rope attachment 46, cam members 12, 14, 16 and 18 are simultaneously forced to rotate toward their retracted positions.

In FIG. 2, cam members 12 and 14 are shown in their fully retracted positions, and cam members 16 and 18 are shown at their fully extended positions. Consequently, operating bar 68 is shown tilted to depict the movement which independently retracted cam members 12 and 16.

When improved climbing aid 10 is inserted within the generally parallel walls of a crack in rock, or the like, torsion spring 50 forces opposed rotation of cam members 12 and 14 until contact is made with the crack walls. Torsion spring 50 also acts to maintain frictional engagement of cam members 12 and 14 with the crack walls until an outwardly directed load is applied at climbing rope attachment 46. Similarly, torsion spring 52 rotates and maintains frictional engagement of cam members 16 and 18. Because of the frictional engagement with the crack walls, any outwardly directed load will tend to force cam members 12, 14, 16 and 18 even more toward their fully open positions thereby jamming and locking improved climbing aid 10 within the crack. Without a load applied, and when cam members 12, 14, 16 and 18 are retracted by use of operating bar 68, improved climbing aid 10 can easily be either inserted in or removed from the crack.

Operating links 60, 62, 64 and 66 are lengths of high strength wire rope which are capable of sustaining repeated tension, bending and flexural loads. Alternately, operating links 60, 62, 64 and 66 can be lengths of solid spring wire, or the like. As another, preferred, configuration, the operating links can be a combination of both wire rope and solid wire assembled so that the solid wire hooks at one end to a cam member, and is swaged at its other end to a wire rope which, in turn, is attached to operating bar 68.

Operating bar 68 is fabricated of a relatively rigid material, for example aluminum or nylon. As shown by FIG. 2, operating bar 68 can be configured to slide alone and be guided by the legs of U-shaped cable or bar 40. For the alternate configuration of FIG. 9, operating bar 68 can slide along and be guided by the single centrally located cable or bar 41. Operating bar 68 can also be unguided.

Although the preferred configuration incorporates operating bar 68 in order to facilitate the climber's ability to grasp and pull with a finger, the operating bar can be eliminated by joining the ends of operating links 60, 62, 64 and 66 so that a loop is formed, or loops are formed, within finger reach of climbing rope attachment 46.

Figure 10:
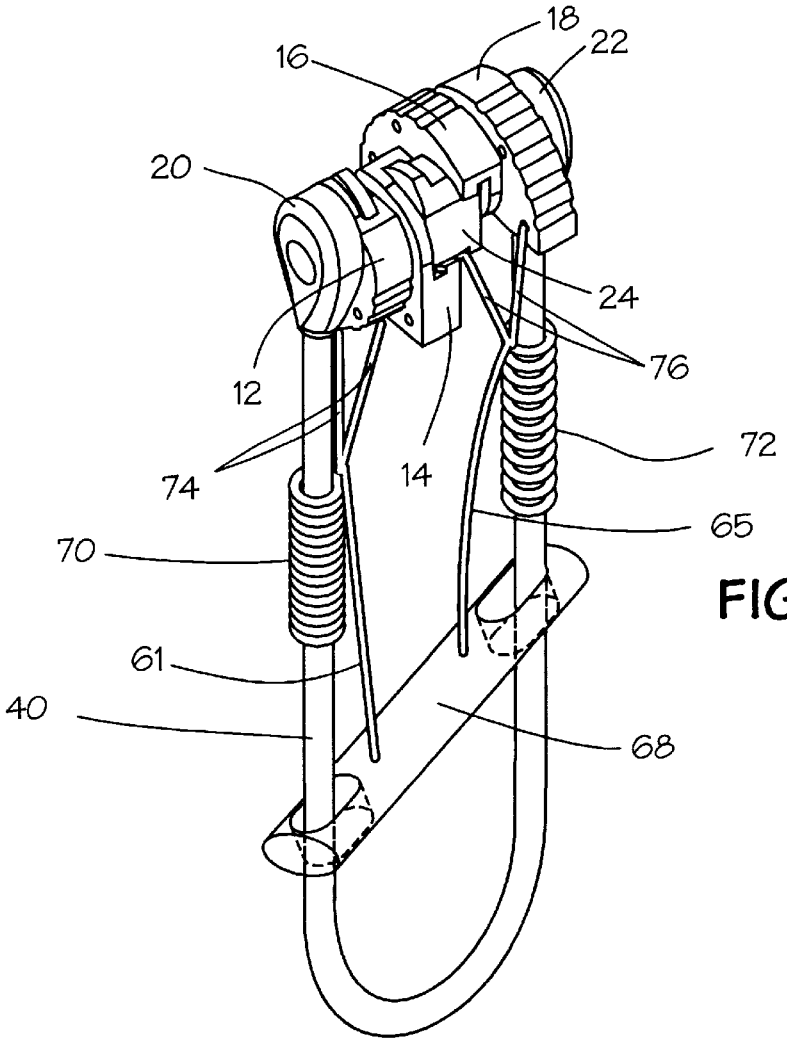
FIG. 10 is an isometric view of an alternate climbing aid.

Referring to FIG. 10, an alternate spring configuration is shown which includes a first compression spring 70 and a second compression spring 72 loosely riding on and guided by the legs of U-shaped cable 40. First and second springs 70 and 72 are in compression and push against a pair of first operating wires 74 and a pair of second operating wires 76, respectively. First and second operating wires 74 and 76 are lengths of spring wire, or the like, which are capable of sustaining repeated tension, bending and flexural loads but which are short enough to support the compressive loads of first and second springs 70 and 72 without buckling. The ends of first operating wires 74 are attached to opposed cam members 12 and 14 so that compressive forces from spring 70 serve to urge cam members 12 and 14 to rotate in opposite directions toward their fully extended positions. Similarly, the ends of operating wires 76 are attached to opposing cam members 16 and 18 so that compressive forces from spring 72 serve to urge cam members 16 and 18 toward their fully extended positions. A single operating link 61 joins operating wires 74 to operating bar 68. Similarly, a single operating link 65 joins operating wires 76 to operating bar 68.

Because first spring 70 and first operating wires 74 are free to move independently of second spring 72 and second operating wires 76, and the reverse, the first pair of opposing cam members 12 and 14 are free to move independently of the second pair of opposing cam members 16 and 18, and the reverse. Such independent action enables all of the cam members to make contact with non-parallel or uneven crack walls.

In FIG. 10, cam members 12 and 14 are shown in their fully retracted positions, and cam members 16 and 18 are shown at their fully extended positions. Consequently, spring 70 is shown nearly fully compressed and operating bar 68 is shown tilted to depict the movement which retracted cam members 12 and 16.

For yet another alternate configuration, central cam members 14 and 16 can be combined and replaced with a single cam member. The resultant three cam member configuration can be advantageously fabricated narrower than a four cam member configuration for placement in situations where the usable crack in rock is very limited in size. The torsional spring arrangement, or the alternative compression spring arrangement, of the four cam member configuration can also be applied to the three cam member configuration. Similarly, the operating links and operating bar of the four cam member configuration can be similarly incorporated on the three cam member configuration.

Figure 11:
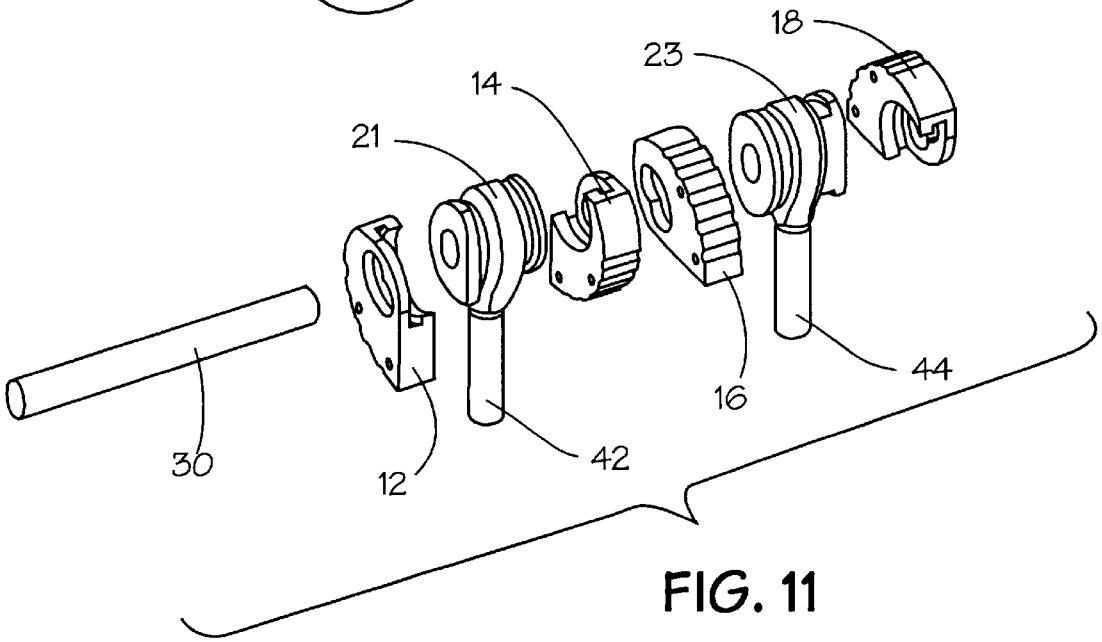
FIG. 11 is an exploded isometric view of an alternate cam member and eccentric bearing configuration.

Other variations on the interlocking means between the bearings and the cam members are contemplated as are variations of the number and location of the eccentric bearings and cam members themselves. For example, FIG. 11 pictures an exploded view of a configuration having opposing cam members which ride on appropriate eccentric bearings located on either side of combined bearing components 21 and 23 respectively. The configuration of FIG. 11 has the advantage of eliminating the need for a separate inner eccentric bearing. The configuration of FIG. 11 has the disadvantage of not having a convenient location to place torsion springs, consequently, the compression spring arrangement of FIG. 10 is best utilized for this alternate configuration.

It is understood that those skilled in the art may conceive of modifications and/or changes to the invention described above. Any such modifications or changes which fall within the purview of the description are intended to be included therein as well. This description is intended to be illustrative and is not intended to be limitative. The scope of the invention is limited only by the scope of the claims appended hereto.

I claim:

1. A climbing aid comprising:

opposing cam members;

eccentric bearings corresponding to said opposing cam members; said eccentric bearings each having an off-center axis of rotation around which said opposing cam members rotate with crossed radii;

rope attachment means;

forcing means for expanding said cam members; and operating means for retracting said cam members.

2. The climbing aid recited in claim 1 wherein:

said forcing means is situated between said opposing cam members.

3. The climbing aid recited in claim 2 wherein:

said forcing means are torsion springs.

4. The climbing aid recited in claim 1 wherein:

said forcing means are compression springs.

5. The climbing aid recited in claim 1 wherein:

said operating means is a bar attached with linking means to each cam member.

6. The climbing aid recited in claim 1 wherein:

said eccentric bearings are joined by connecting means.

7. The climbing aid recited in claim 6 wherein:

said cam members each define a cutout shaped to provide clearance for limited angular movement with respect to said connecting means.

8. The climbing aid recited in claim 6 wherein:

said connecting means is a single bar.

9. The climbing aid recited in claim 1 wherein:

said rope attachment means is a wire rope joined to at least one of said eccentric bearings.

10. The climbing aid recited in claim 1 wherein:

said rope attachment means is a solid bar joined to at least one of said eccentric bearings.

11. The climbing aid recited in claim 1 wherein:

said cam members have means to interlock with said eccentric bearings.

12. A climbing aid comprising:

at least one set of opposing cam members;

eccentric bearings corresponding to said opposing cam members;

said opposing cam members pivot on said eccentric bearings;

said cam members interlock with said eccentric bearings;

said eccentric bearings have off-center axis of rotation around which said opposing cam members pivot with crossed radii;

forcing means for expanding said opposing cam members;

rope attachment means; and operating means for retracting said opposing cam members.

13. A climbing aid comprising:

a first cam that rotates on a first eccentric bearing;

said first eccentric bearing defines an axis of rotation not situated at its geometric center;

a second cam that rotates on a second eccentric bearing;

said second eccentric bearing defines an axis of rotation not situated at its geometric center;

rope attachment means;

means for expanding and retracting said cams;

wherein said cams rotate with crossed radii.

14. The climbing aid recited in claim 13 including:

at least one eccentric bearing mounting member.

15. The climbing aid recited in claim 13 including:

interlocking means holding said cams and said eccentric bearings together.

* * * * *